US006785940B1

(12) United States Patent
Müller

(10) Patent No.: US 6,785,940 B1
(45) Date of Patent: Sep. 7, 2004

(54) APPARATUS FOR NEEDLING A NON-WOVEN MATERIAL

(75) Inventor: Karl Müller, Wels (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 0 days.

(21) Appl. No.: 10/724,937

(22) Filed: Dec. 1, 2003

(51) Int. Cl.[7] ..... D04H 18/00
(52) U.S. Cl. ..... 28/114; 28/107
(58) Field of Search ..... 28/107, 114, 113, 28/115, 108, 109, 110, 111, 112; 112/80.4, 80.41, 80.42

(56) References Cited

U.S. PATENT DOCUMENTS

| | | | | | |
|---|---|---|---|---|---|
| 3,849,845 | A | * | 11/1974 | Obenaus | 28/107 |
| 4,891,870 | A | * | 1/1990 | Muller | 28/107 |
| 5,873,152 | A | * | 2/1999 | Jourde et al. | 28/107 |
| 6,000,112 | A | * | 12/1999 | Ollinger et al. | 28/114 |
| 6,266,856 | B1 | * | 7/2001 | Fehrer et al. | 28/114 |
| 6,305,058 | B1 | * | 10/2001 | Fehrer | 28/107 |
| 6,389,665 | B1 | * | 5/2002 | Fuchs et al. | 28/114 |
| 6,481,071 | B1 | * | 11/2002 | Fehrer et al. | 28/107 |
| 6,568,051 | B2 | * | 5/2003 | Legl et al. | 28/114 |
| 6,584,659 | B2 | * | 7/2003 | Legl et al. | 28/114 |
| 2002/0162203 | A1 | * | 11/2002 | Legl et al. | 28/114 |

FOREIGN PATENT DOCUMENTS

| | | |
|---|---|---|
| AT | 406390 | 4/2000 |
| DE | 19910945 | 10/1999 |
| WO | WO 01/76812 | 10/2001 |

* cited by examiner

*Primary Examiner*—Amy Brooke Vanatta
(74) *Attorney, Agent, or Firm*—Collard & Roe, P.C.

(57) ABSTRACT

An apparatus is described for needling a non-woven material with at least one needleboard (1) which is drivable in a reciprocating manner by at least one eccentric drive in the needle-penetration direction, which needleboard is linked to the eccentric drive via push rods (6) each displaceably held in a guide sleeve (7), which eccentric drive consists of two parallel eccentric shafts (2, 3) which are drivable in opposite directions and are provided with connecting rods (4), with the guide sleeves (7) being swivelably held about an axle (8) extending parallel to the eccentric shafts (2, 3). In order to provide simple constructional conditions it is proposed that the two eccentric shafts (2, 3) are provided with a different angular position (ϕ) and that the connecting rods (4) of the two eccentric shafts (2, 3) extend in an inclined manner with respect to each other.

4 Claims, 4 Drawing Sheets

APPARATUS FOR NEEDLING A NON-WOVEN MATERIAL

FIELD OF THE INVENTION

The invention relates to an apparatus for needling a non-woven material with at least one needleboard which is drivable in a reciprocating manner by at least one eccentric drive in the needle-penetration direction, which needleboard is linked to the eccentric drive via push rods each displaceably held in a guide sleeve, which eccentric drive consists of two parallel eccentric shafts which are drivable in opposite directions and are provided with connecting rods, with the guide sleeves being swivelably held about an axle extending parallel to the eccentric shafts.

DESCRIPTION OF THE PRIOR ART

In order to increase the advance of the non-woven material at a compact construction it is known (DE 199 10 945 A1) to link the needleboard to an eccentric drive via push rods which are each displaceably held in a guide sleeve, which eccentric drive consists of two parallel eccentric drives which are drivable in opposite directions and are provided with connecting rods, with the guide sleeves being swivelably held about an axle extending parallel to the eccentric shafts, so that the guide sleeves can be swiveled for an additional drive of the needleboard in the direction of advance of the non-woven material. A further eccentric drive is used for driving the guide sleeves, which eccentric drive comprises on its part two eccentric shafts. The connecting rods of said eccentric shafts are connected to a coupler, to which a guide arm is linked which is rigidly connected with the guide sleeves. Since the stroke of the point of articulation of the guide arm on the coupler depends on the coupling movement and thus the mutual phase position of the two eccentric shafts in the case of given eccentricities, the swiveling stroke for the guide sleeves can be set via a device for adjusting the mutual angular position of the eccentric shafts. Despite the possibility achieved by this construction to keep the connecting rods of the eccentric drive short for the needleboard movement in the direction of advance of the non-woven material and thus to house said eccentric drive in a common housing with the main drive, there is a respective amount of constructional effort involved in the additional eccentric drive for driving the needleboard in the direction of advance of the non-woven material.

SUMMARY OF THE INVENTION

The invention is thus based on the object of providing an apparatus for needling a non-woven material of the kind mentioned above with simple constructional means in such a way that a considerable constructional simplification is ensured without having to make do without a needleboard drive in the direction of advance of the non-woven material.

This object is achieved by the invention in such a way that the two eccentric shafts are provided with a different angular position and that the connecting rods of the two eccentric shafts extend in an inclined manner with respect to each other.

Since the connecting rods of the two oppositely drivable eccentric drives for the needleboard drive in the needle-penetration direction are not provided, as is otherwise usual, with a central position extending in the needle-penetration direction but extend inclined in opposite directions with respect to the needle-penetration direction, the needleboard can be driven along an inherently closed trajectory by a phase shift between said two eccentric drives, because the push rods are swiveled with the guide sleeves about the swiveling axis of the guide sleeves via the connecting rods when a respective forced guidance of the connecting rods is ensured.

This forced guidance can be ensured in a simple way when arranging the needleboard in such a way that the connecting rods act upon the push rods via coaxial link axles. The needleboard drive in accordance with the invention can also be extended to two needleboards arranged successively in the direction of the advance of the non-woven material which needleboards are each driven via push rods held in swivelable guide sleeves by a common eccentric drive. In this case the push rods of the two needleboards must be coupled via a coupler on which act the push rods of the eccentric shafts. The coupler needs to be guided in addition in order to achieve the forced guidance of the connecting rods of the two eccentric shafts. For this reason the coupler is held in a lifting guide means and in a middle position extending in the direction of the needle penetration is swiveled about an axis parallel to the eccentric shafts. This lifting guidance allows the lifting movement of the coupler which is required for the needleboard drive in the needle-penetration direction, which coupler swivels out as a result of its design transversally to the penetration direction during the penetration stroke as a result of its additional swiveling bearing and thus ensures a respective swiveling displacement of the push rods which are held in the guide sleeves. A displacement guide means can be provided as a lifting guide means, which displacement guide means is held in a manner so as to be swivelable about an axle parallel to the eccentric shafts. Another embodiment of the lifting guide means is to link the coupler at least to one transverse link extending transversally to the needle-penetration direction. A respective four-bar linkage can be used to achieve a straight guidance of the linkage axle between coupler and lifting guide means when symmetrical conditions are required for both needleboard drives.

In order to enable the setting of the needleboard stroke in the direction of the advance of the non-woven material during a needling process, it is merely necessary to displace the two eccentric shafts in their mutual angular position, which can be achieved very easily from a constructional viewpoint.

BRIEF DESCRIPTION OF THE DRAWINGS

The subject matter of the invention is shown by way of example in the drawings, wherein.

DESCRIPTION OF THE PREFERRED EMBODIMENTS

Figure 1:
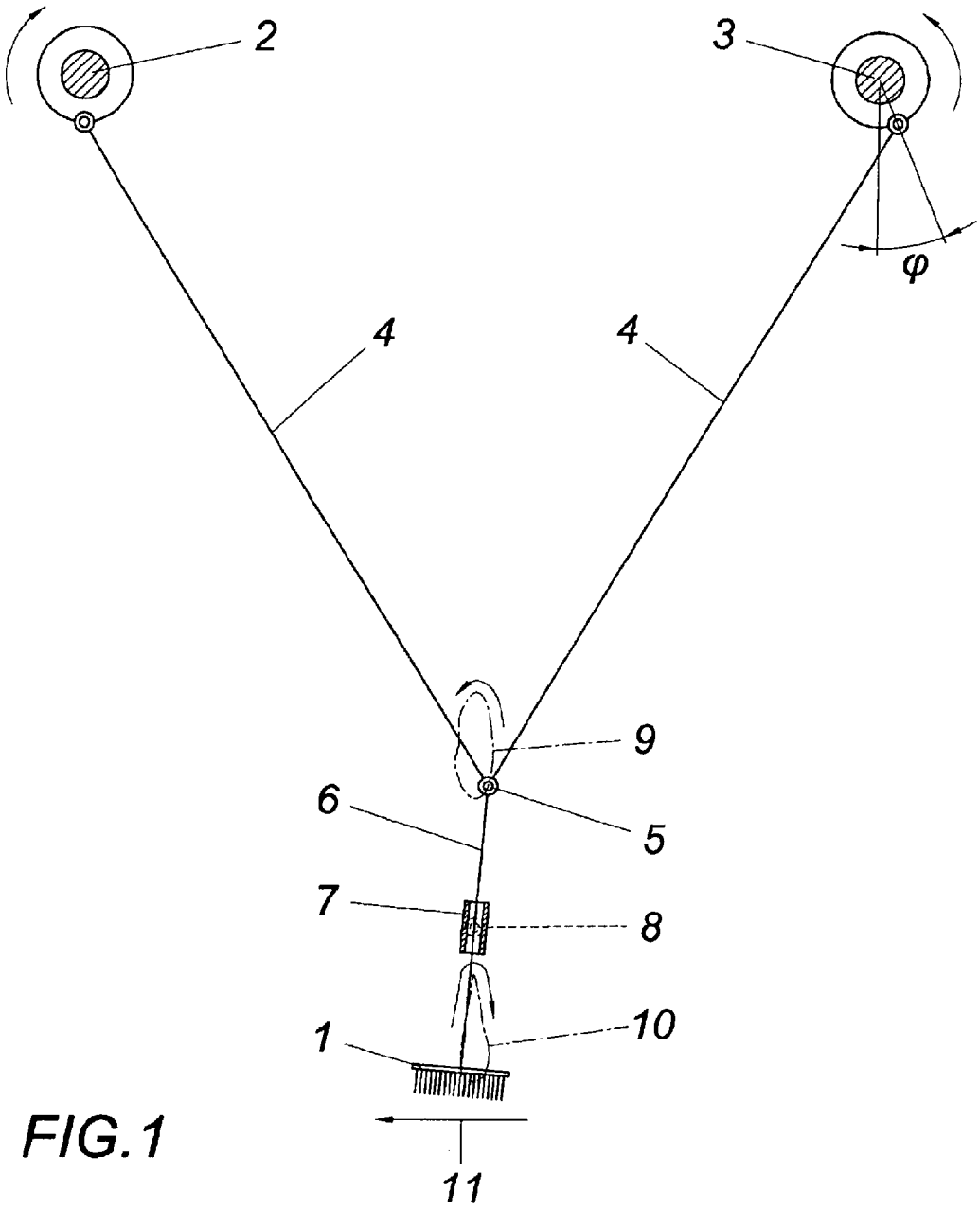
FIG. 1 shows an eccentric drive for an apparatus in accordance with the invention for needling a non-woven material in a schematic diagram.

As can be seen from the schematic diagram according to FIG. 1, the eccentric drive for driving a needleboard 1 of a needling apparatus for a non-woven material comprises two eccentric shafts 2 and 3 whose connecting rods 4 act upon push rods 6 via coaxial link axles 5, which push rods are arranged in parallel successively behind one another in the direction of the link axles 5 and are connected with the needleboard 1. Said push rods 6 are each guided in a guide sleeve 7 which are held in a swivelable manner about a common axle 8 which is parallel to the eccentric shafts 2 and 3. The two eccentric shafts 2 and 3 are mutually phase-shifted by an angle $\phi$, leading to a trajectory 9 of the coaxial link axles 5 in cooperation with the mutual inclination of the connecting rods 4 when the eccentric shafts 2 and 3 are operated in an oppositely revolving manner. The trajectory 9 of the link axles 5 leads to a trajectory 10 for the needleboard 1 as a result of the swivelable bearing of the guide sleeves 7, which trajectory is passed in an opposite direction to the trajectory 9, as is indicated by the revolving arrows. In FIG. 1 the needleboard 1 is represented at the end of the swiveling stroke in the direction 11 of the advance of the non-woven material after passing through the lower return point of the trajectory 10 during the extraction of the needles from the non-woven material. The trajectories 9 and 10 are determined by the eccentricity of the eccentric shafts 2 and 3 whose mutual distance determines the phase angle $\phi$ between the two eccentric shafts 2 and 3 and the transmission ratio arising form the respectively effective lever lengths of the connecting rods 4 and the push rods 6 and by the position of the pivoting axle 8.

Figure 2:
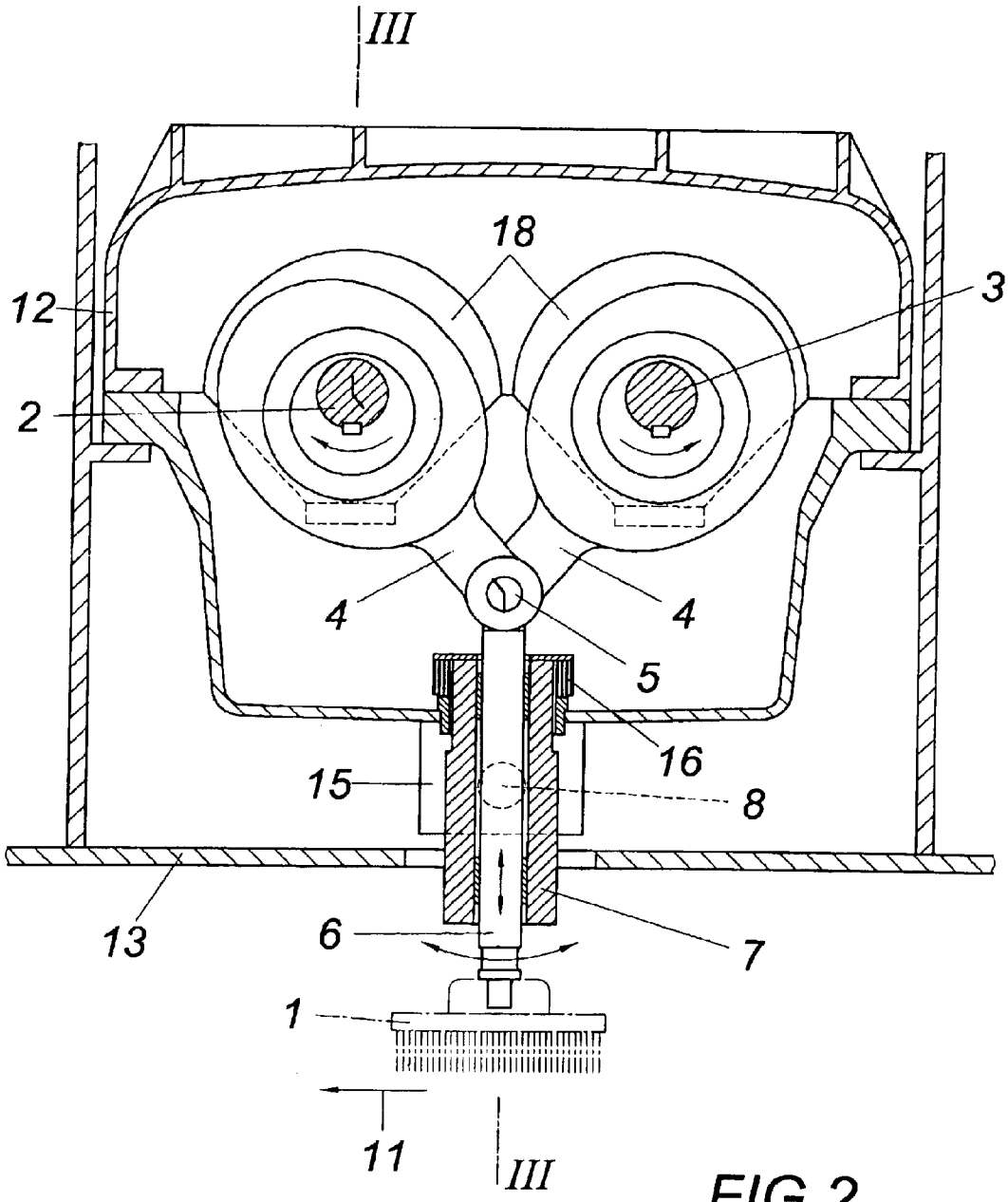
FIG. 2 shows a construction of a needleboard drive arranged according to the schematic diagram of FIG. 1 in a simplified sectional view perpendicular to the eccentric shafts.
Figure 3:
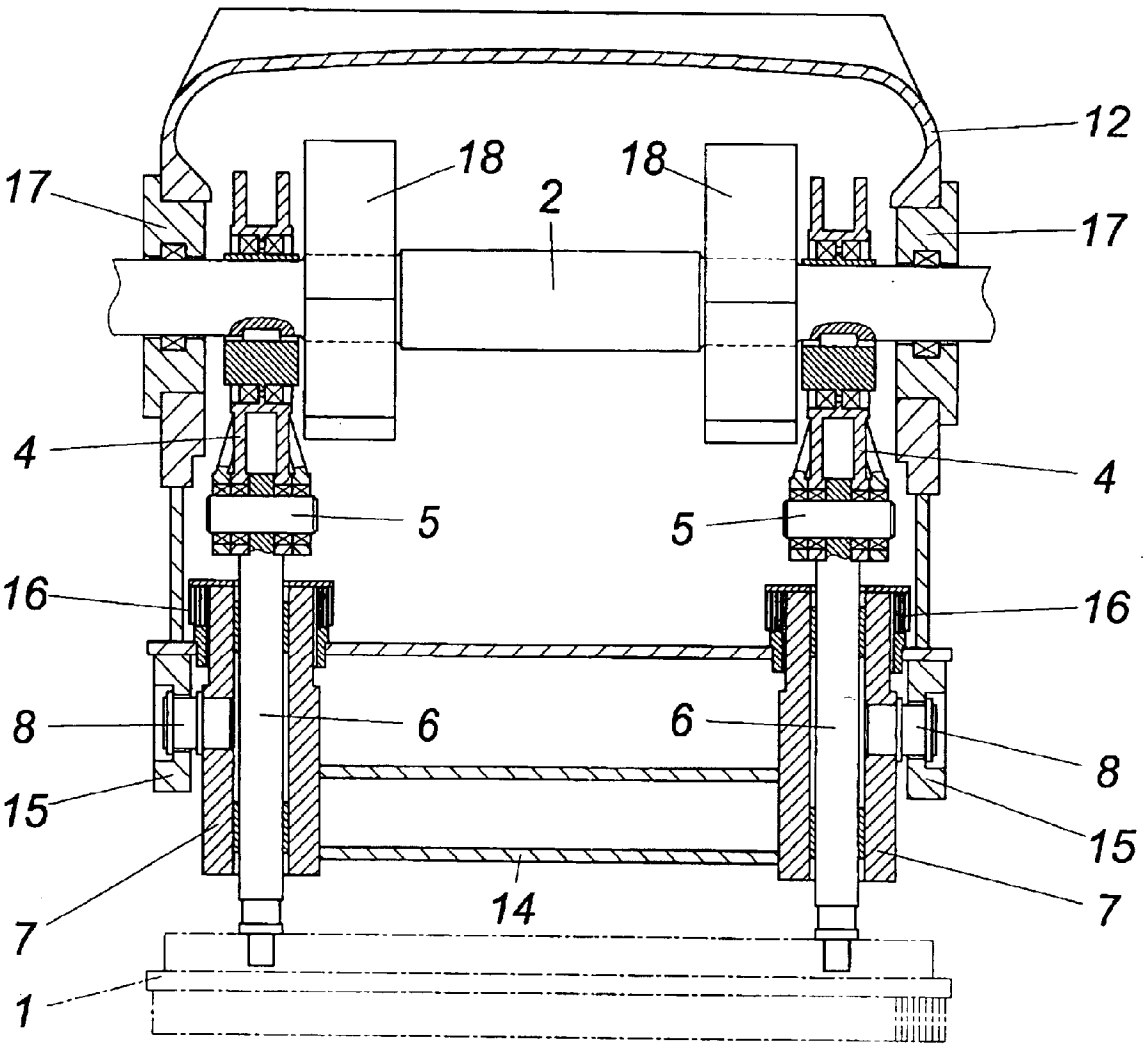
FIG. 3 shows a sectional view along line III—III of FIG. 2.

FIGS. 2 and 3 show a constructional arrangement of an eccentric drive according to FIG. 1. The two eccentric shafts 2 and 3 are held in a housing 12 which is carried by a machine frame 13. Guide sleeves 7 are held on the housing 12, which guide sleeves are mutually connected by a carrier 14. The swiveling axles 8 of the sleeves 7 are held in a rotatable manner in the bearing bodies 15 of housing 12. Respective bellows-type seals are provided to seal the guide sleeves 7 which are swivelable relative to the housing 12. The push rods 6 which are held in an axially displaceable manner in the guide sleeves 7 are linked to the connecting rods 4 of the eccentric shafts 2 and 3, with the link axles 5 extending coaxially with respect to each other. The eccentric shafts 2 and 3 which penetrate the housing 12 in bearings 17 are driven in opposite directions and are provided with counterweights 18 for balancing the masses.

Figure 4:
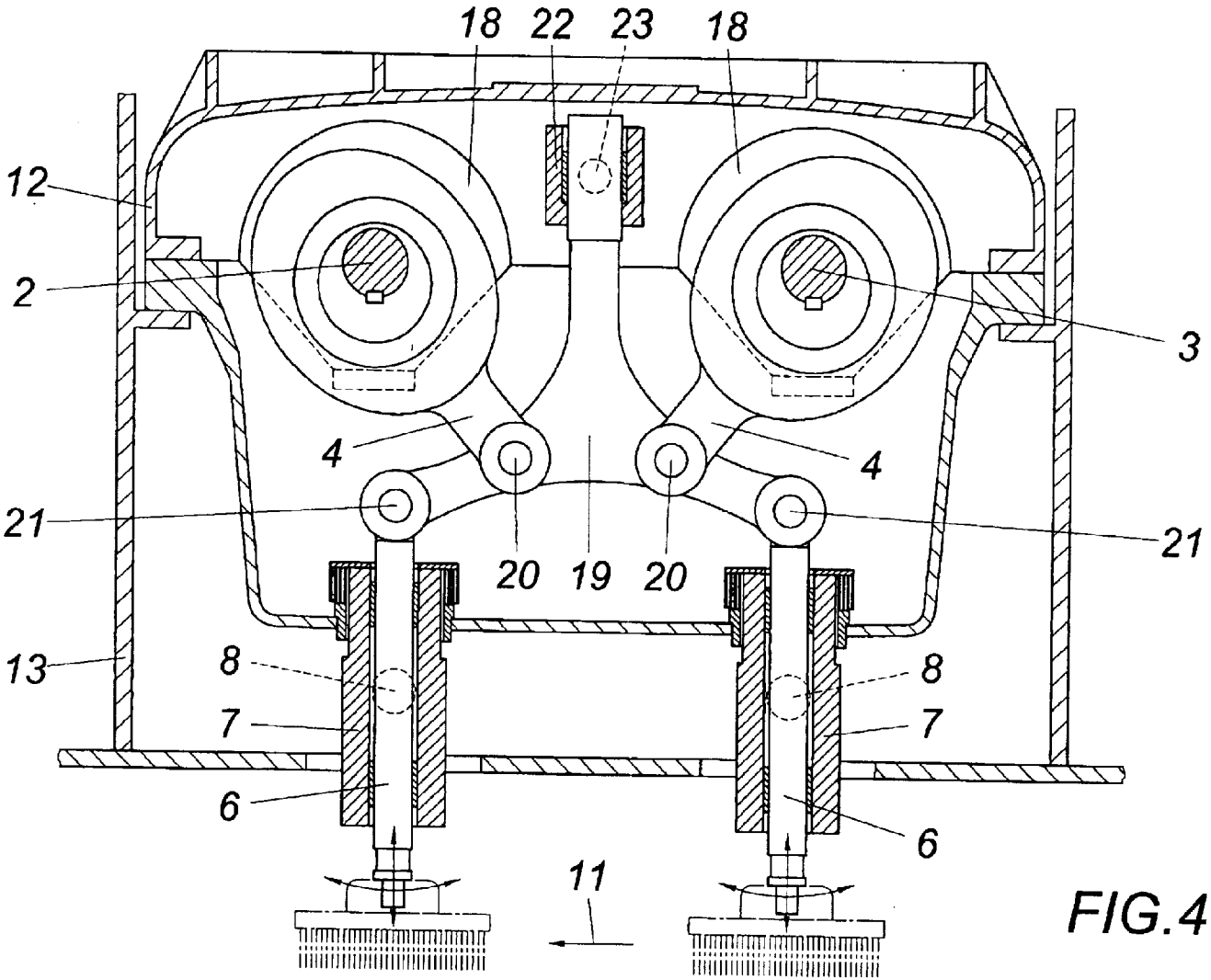
FIG. 4 shows a representation corresponding to FIG. 2 of a needleboard drive in accordance with the invention, but not for one but for two needleboard drives arranged successively behind one another.

FIG. 4 shows an eccentric drive for driving two needleboards 1 which are arranged successively behind one another in the direction of passage of the non-woven material and whose push rods 6 are held in guide sleeves 7 in an axially displaceable way according to the embodiment of FIGS. 2 and 3 and are held jointly with the guide sleeves 7 in a swivelable manner about the swiveling axles 8. The connecting rods 4 of the two eccentric shafts 2 and 3 do not act upon the push rods 6 in a direct way, but via a coupler 19. The link axles between the connecting rods 4 and the coupler 19 are designated with reference numeral 20, and those between coupler 19 and the push rods 6 with reference numeral 21. The link axles 20 and 21 can also coincide for each needleboard 1 when a respective opposite inclination of the connecting rods 4 relative to the needle penetration direction is ensured.

In order to achieve a forced guidance for the coupler 19, the coupler 19 is held in a lifting guide means 22 which consists according to the represented embodiment of a displacement guide means for the coupler 19. Said displacement guide means is held swivelably about a central position extending in the direction of the needle penetration in the housing 12 about an axle 23 parallel to the eccentric shafts 2, 3. This measure ensures that the lifting movement of the coupler 19 is associated with a swiveling movement about the axle 23 when the eccentric shafts 2 and 3 are driven with an opposite phase angle, so that as a result of the swiveling movement of the coupler 19 the push rods 6 and thus the needleboards which are arranged on the push rods 6 are displaced in a reciprocating manner about the swiveling axles 8 of the guide sleeves 7 in order to ensure an additional swiveling stroke in the direction 11 of advance of the non-woven material. Another possibility for arranging the lifting guide means 22 would be of providing a coupler bar system which preferably represents a straight guidance such as Watt's coupler bar to which the coupler is linked.

What is claimed is:

1. An apparatus for needling a non-woven material with at least one needleboard which is drivable in a reciprocating manner by at least one eccentric drive in the needle-penetration direction, which needleboard is linked to the eccentric drive via push rods each displaceably held in a guide sleeve, which eccentric drive consists of two parallel eccentric shafts which are drivable in opposite directions and are provided with connecting rods, with the guide sleeves being swivelably held about an axle extending parallel to the eccentric shafts, characterized in that the two eccentric shafts (2, 3) are provided with a different angular position ($\phi$) and that the connecting rods (4) of the two eccentric shafts (2, 3) extend in an inclined manner with respect to each other.

2. An apparatus as claimed in claim 1, characterized in that in the arrangement of one needleboard (1) the connecting rods (4) act upon the push rods via coaxial link axles (5).

3. An apparatus as claimed in claim 1, characterized in that when two needleboards (1) are arranged successively behind one another in the direction (11) of passage of the non-woven material the push rods (6) of the two needleboards (1) are connected by a coupler (19) on which act the connecting rods (4) of the eccentric shafts (2, 3), and that the coupler (19) is held in a lifting guide means (22) and can be swiveled in a middle position extending in the needle-penetration direction about an axle (23) which is parallel to the eccentric shafts (2, 3).

4. An apparatus as claimed in claim 1, characterized in that the two eccentric shafts (2, 3) are adjustable in their mutual angular position.

* * * * *